US009804517B2

(12) United States Patent
Tsuchihashi

(10) Patent No.: US 9,804,517 B2
(45) Date of Patent: Oct. 31, 2017

(54) ELECTROSTATIC LATENT IMAGE DEVELOPING TONER

(71) Applicant: KYOCERA Document Solutions Inc., Osaka (JP)

(72) Inventor: Kazuki Tsuchihashi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/296,732

(22) Filed: Oct. 18, 2016

(65) Prior Publication Data

US 2017/0115583 A1 Apr. 27, 2017

(30) Foreign Application Priority Data

Oct. 21, 2015 (JP) ..... 2015-207125

(51) Int. Cl.
*G03G 9/093* (2006.01)
*G03G 9/08* (2006.01)
*G03G 9/087* (2006.01)

(52) U.S. Cl.
CPC ..... *G03G 9/0825* (2013.01); *G03G 9/0819* (2013.01); *G03G 9/08711* (2013.01); *G03G 9/08728* (2013.01); *G03G 9/08733* (2013.01); *G03G 9/08755* (2013.01); *G03G 9/09364* (2013.01); *G03G 9/09371* (2013.01); *G03G 9/09392* (2013.01)

(58) Field of Classification Search
CPC ..... G03G 9/09307; G03G 9/09321
See application file for complete search history.

(56) References Cited

U.S. PATENT DOCUMENTS 4,980,257 A * 12/1990 Anno ..... G03G 9/0825 428/407
2007/0065745 A1* 3/2007 Gerroir ..... G03G 9/09314 430/110.2

FOREIGN PATENT DOCUMENTS

JP 2001-201891 A 7/2001

* cited by examiner

*Primary Examiner* — Peter Vajda
(74) *Attorney, Agent, or Firm* — Studebaker & Brackett PC

(57) ABSTRACT

An electrostatic latent image developing toner contains a plurality of toner particles each including a toner core and a shell layer disposed over a surface of the toner core. The shell layer has at least one first domain having a film shape and a plurality of second domains each having a particle shape. The first domain is formed substantially from a non-crosslinked resin. The second domains are formed substantially from a crosslinked resin. The crosslinked resin has a glass transition point 45° C. or more greater than the non-crosslinked resin. The first domain has an average height from the surface of the toner core of at least 10 nm and less than 50 nm. The second domains have an average height from the surface of the toner core of at least 50 nm and no greater than 100 nm.

11 Claims, 4 Drawing Sheets

ELECTROSTATIC LATENT IMAGE DEVELOPING TONER

INCORPORATION BY REFERENCE

The present application claims priority under 35 U.S.C. §119 to Japanese Patent Application No. 2015-207125, filed on Oct. 21, 2015. The contents of this application are incorporated herein by reference in their entirety.

BACKGROUND

The present disclosure relates to an electrostatic latent image developing toner.

Toner particles contained in a capsule toner each have a core and a shell layer (capsule layer) disposed over a surface of the core. In an example of a capsule toner producing method, cores (toner cores) are mixed with resin particulates having two different glass transition points (glass transition temperatures) to form shell layers on the surfaces of the respective cores.

SUMMARY

An electrostatic latent image developing toner according to the present disclosure includes a plurality of toner particles each including a core and a shell layer disposed over a surface of the core. The shell layer has at least one first domain having a film shape and a plurality of second domains each having a particle shape. The first domain is formed substantially from a non-crosslinked resin. The second domains are formed substantially from a crosslinked resin. The crosslinked resin has a glass transition point 45° C. or more greater than the non-crosslinked resin. The first domain has an average height from the surface of the core of at least 10 nm and less than 50 nm. The second domains have an average height from the surface of the core of at least 50 nm and no greater than 100 nm.

DETAILED DESCRIPTION

Figure 1:
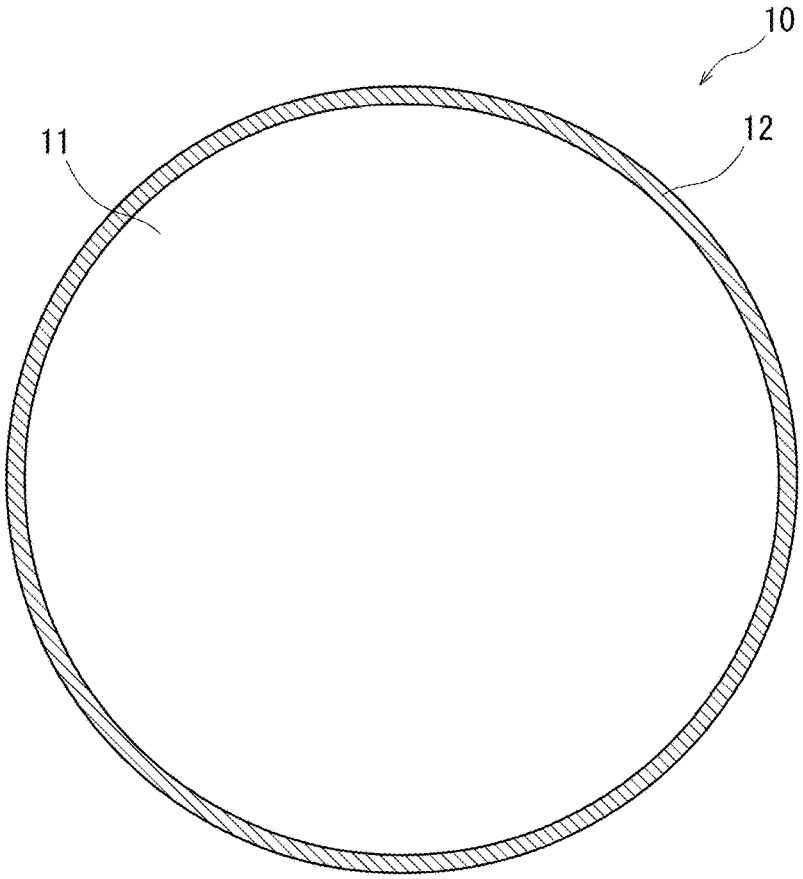
FIG. 1 is a cross sectional view illustrating an example of a toner particle (specifically, a toner mother particle) contained in an electrostatic latent image developing toner according to an embodiment of the present disclosure.

The following explains an embodiment of the present disclosure in detail. Unless otherwise stated, evaluation results (for example, values indicating shape and physical properties) for a powder (specific examples include toner cores, toner mother particles, external additive, and toner) are number averages of values measured for a suitable number of particles.

Unless otherwise stated, a number average particle diameter of the powder is a number average value of equivalent circular diameters of primary particles (diameters of circles having the same areas as projected areas of the respective particles) measured using a microscope. A measured value of a volume median diameter ($D_{50}$) of the powder is a value measured using "Coulter Counter Multisizer 3" manufactured by Beckman Coulter, Inc. unless otherwise stated. Respective measured values of an acid value and a hydroxyl value are values measured in accordance with Japan Industrial Standard (JIS) K0070-1992 unless otherwise stated. A number average molecular weight (Mn) and a mass average molecular weight (Mw) are values measured by gel permeation chromatography unless otherwise stated.

In the present description, the term "-based" may be appended to the name of a chemical compound in order to form a generic name encompassing both the chemical compound itself and derivatives thereof. When the term "-based" is appended to the name of a chemical compound used in the name of a polymer, the term indicates that a repeating unit of the polymer originates from the chemical compound or a derivative thereof. In the present description, the term "(meth)acryl" is used as a generic term for both acryl and methacryl.

A toner according to the present embodiment can be favorably used as for example a positively chargeable toner for development of an electrostatic latent image. The toner according to the present embodiment is a powder containing a plurality of toner particles (particles each having structure described later in detail). The toner may be used as a one-component developer. Alternatively, the toner may be mixed with a carrier using a mixer (specific example include a ball mill) to prepare a two-component developer. A ferrite carrier is preferably used as the carrier in order to form a high-quality image. It is preferable to use magnetic carrier particles each including a carrier core and a resin layer that covers the carrier core in order to form high-quality images for a long period of time. Carrier cores may be formed from a magnetic material (for example, a ferromagnetic material such as ferrite) or a resin in which magnetic particles are dispersed in order to impart magnetism to the carrier particles. Alternatively, magnetic particles may be dispersed in resin layers that cover respective carrier cores. The amount of the toner in a two-component developer is preferably at least 5 parts by mass and no greater than 15 parts by mass relative to 100 parts by mass of the carrier, and more preferably at least 8 parts by mass and no greater than 12 parts by mass, in order to form a high-quality image. Note that the positively chargeable toner contained in the two-component developer is positively charged by friction with the carrier.

The toner particles contained in the toner according to the present embodiment each include a core (also referred to below as a toner core) and a shell layer (capsule layer) disposed over a surface of the toner core. The toner core contains a binder resin. The toner core may optionally contain an internal additive (for example, a colorant, a releasing agent, a charge control agent, and a magnetic powder). An external additive may be attached to a surface of the shell layer (or a surface region of the toner core that is not covered with the shell layer). Note that the external additive may be omitted in a situation in which such additives are not necessary. Hereinafter, toner particles that are yet to be subjected to addition of an external additive are referred to as toner mother particles. A material for forming the shell layers is referred to as a shell material.

The toner according to the present embodiment can be used for for example image formation using an electrophotographic apparatus (image forming apparatus). Following describes an example of an image forming method using an electrophotographic apparatus.

First, an image forming section (a charger and an exposure device) of the electrophotographic apparatus forms an electrostatic latent image on a photosensitive member (for example, a surface layer portion of a photosensitive drum) based on image data. Next, the formed electrostatic latent image is developed using a developer containing a toner. In a development process, toner (for example, toner charged by friction with the carrier or a blade) on a development sleeve (for example, a surface layer portion of a development roller in the developing device) disposed in the vicinity of the photosensitive member is attached to the electrostatic latent image to form a toner image on the photosensitive member. In a subsequent transfer process, the toner image on the photosensitive member is transferred to an intermediate transfer member (for example, a transfer belt), and the toner image on the intermediate transfer member is further transferred to a recording medium (for example, paper). Thereafter, a fixing device (fixing method: nip fixing using a heating roller and a pressure roller) applies heat and pressure to the toner to fix the toner to the recording medium. As a result, an image is formed on the recording medium. A full-color image can be obtained by superimposing toner images formed using different colors, such as black, yellow, magenta, and cyan. A belt fixing method may be adopted as a fixing method.

The toner according to the present embodiment is an electrostatic latent image developing toner having the following structure (also referred to below as basic structure).

(Basic Structure of Toner)

The electrostatic latent image developing toner contains a plurality of toner particles each including a toner core and a shell layer. The shell layer has at least one first domain having a film shape and second domains each having a particle shape. The first domain is formed substantially from a non-crosslinked resin. The second domains are formed substantially from a crosslinked resin. The crosslinked resin has a glass transition point (Tg) 45° C. or more greater than the non-crosslinked resin. The first domain has an average height (hereinafter referred to as a first shell thickness) from the surface of the toner core of at least 10 nm and less than 50 nm. The second domains have an average height (hereinafter referred to as a second shell thickness) from the surface of the toner core of at least 50 nm and no greater than 100 nm. The first domain may each have a film shape with or without granular appearance. A method for measuring the first and second shell thicknesses is the same as that described in Examples described later or an alternative method thereof.

The toner having the above basic structure is excellent in both high-temperature preservability and fixability. Operation and advantages of the above basic structure will be described below.

For example, high-temperature preservability of the toner can be improved by covering each of the toner cores with a resin film. Resin particles can be used as a material used for forming the resin film. The resin film can be formed by dissolving (or deforming) resin particles and hardening them into a film shape. When the resin film is formed on the surface of each toner core using non-crosslinked resin particles having a low glass transition point (Tg), a wide range of the surface of each toner core can be covered with a thin resin film (film of a non-crosslinked resin having a low Tg). However, the non-crosslinked resin film formed as above tends to involve significant variation in thickness. Irregularity in film thickness as above is expected to be caused due to agglomeration of the resin particles. When an area ratio of a region of the surface region of the toner core where the toner core is exposed from the resin film (region not covered with the resin film) is large, high-temperature preservability of the toner tends to be impaired. By contrast, when the thickness of the resin film is increased so that the surface of the toner core is covered entirely with the resin film, low-temperature fixability of the toner tends to be impaired.

The inventor has found that uniform shell layers can be formed (and sufficient high-temperature preservability of the toner can be ensured as a result) by covering incompletely (at a low coverage) the surfaces of the toner cores with a non-crosslinked resin film and filling gaps among the films with crosslinked resin particles. The toner having the above basic structure contains the toner cores each including a shell layer having the film-shaped first domain and the particle-shaped second domains. The first domain is formed substantially from a non-crosslinked resin. The second domains are formed substantially from a crosslinked resin. The crosslinked resin has a glass transition point (Tg) 45° C. or more greater than the non-crosslinked resin. Covering the toner cores with the first domain (low-Tg non-crosslinked resin film) and the second domains (high-Tg crosslinked resin particles) can improve both high-temperature preservability and low-temperature fixability of the toner. The presence of the second domains in a region of a surface region of the toner core where the toner core is exposed from the first domain can reduce the first shell thickness comparatively thin to ensure low-temperature fixability of the toner and improve high-temperature preservability of the toner.

In the above basic structure, Tg of the crosslinked resin is 45° C. or more greater than that of the non-crosslinked resin. The second domains, which have a comparatively high Tg, are expected to contribute to improvement in heat resistance of the toner particles. In order to form high-quality shell layers, difference obtained by subtracting Tg of the non-crosslinked resin from Tg of the crosslinked resin (=(Tg of crosslinked resin)−(Tg of non-crosslinked resin)) is preferably at least 45° C. and no greater than 80° C. The respective glass transition points (Tg) of the crosslinked resin and the non-crosslinked resin can be adjusted by for example changing species or amounts (blend ratio) of components (monomers) of the respective resins.

In the above basic structure, the first shell thickness is at least 10 nm and less than 50 nm and the second shell thickness is at least 50 nm and no greater than 100 nm. The inventor has found that formation of shell layers such as above can improve both high-temperature preservability and low-temperature fixability of the toner (see Tables 1-3 indicated later). The second domains each have a comparatively large particle diameter (second shell thickness) relative to the first shell thickness. In the above configuration, the second domains are expected to function as spacers among the toner particles to inhibit agglomeration of the toner particles. In order to enhance functionality of the second domains as the spacers, a difference obtained by subtracting the first shell thickness from the second shell thickness (also referred to below as a shell height difference) is preferably at least 30 nm and no greater than 90 nm. The shell height difference is represented by an equation "shell height difference=(second shell thickness)−(first shell thickness)".

In order to improve both high-temperature preservability and low-temperature fixability of the toner, a first domain and second domains constitute a stacked structure of the first domain and the second domains in stated order from a side close to the toner core. For example, when the low-Tg non-crosslinked resin (or a precursor thereof) is attached to the surfaces of the toner cores and then the high-Tg crosslinked resin particles are attached to the surfaces of the toner cores in shell layer formation, a stacked structure as above can be formed. In a situation in which the first and second domains are formed at the same time, the low-Tg non-crosslinked resin tends to be attached to the toner cores prior to the high-Tg crosslinked resin. However, the non-crosslinked resin films are expected to be partly formed on the crosslinked resin particles. In a configuration in which too many regions where the crosslinked resin particles and the non-crosslinked resin film are stacked in the stated order are present in the surface region of the toner core, low-temperature fixability of the toner is expected to be impaired.

The first and second domains preferably have the same polarity in order to improve both high-temperature preservability and low-temperature fixability of the toner. Electrical repulsion between the first and second domains tends to cause the second domains to be disposed in gaps in the first domain. The first and second domains preferably have an opposite polarity (for example, cationicity) to the polarity (for example anionicity) of the toner cores in order to increase bonding strength between the toner cores and the shell layers.

The glass transition point of the toner cores is preferably lower than that of the non-crosslinked resin of the first domain in the above basic structure in order to improve low-temperature fixability of the toner.

Figure 2:
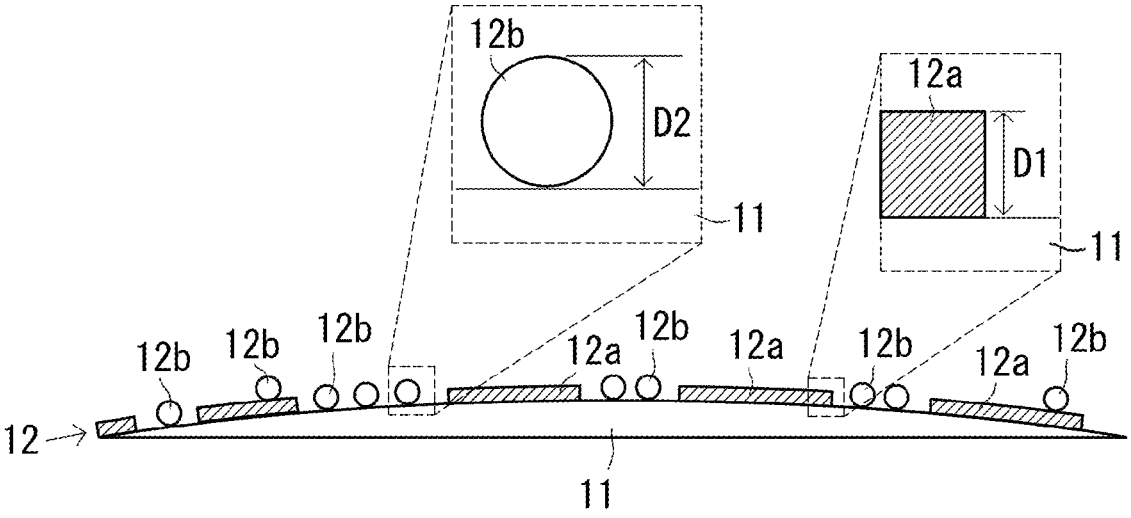
FIG. 2 illustrates in an enlarged scaled a part of a surface of the toner mother particle illustrated in FIG. 1.

Following describes an example of structure of the toner according to the present embodiment with reference to FIGS. 1 and 2. FIG. 1 illustrates an example of a configuration of a toner particle (specifically, a toner mother particle) contained in the toner according to the present embodiment. FIG. 2 is an enlarged view of a part of the toner mother particle illustrated in FIG. 1.

A toner mother particle 10 illustrated in FIG. 1 includes a toner core 11 and a shell layer 12 disposed over a surface of the toner core 11. The shell layer 12 is formed substantially from resin. The shell layer 12 covers a surface of the toner core 11.

As illustrated in FIG. 2, the shell layer 12 of the toner mother particle 10 includes a film-shaped first domain 12*a* and particle-shaped second domains 12*b*. In the example illustrated in FIG. 2, first and second domains 12*a* and 12*b* constitute a stacked structure in order of the first domain 12*a* and the second domain 12*b* from a side close to the toner core 11. That is, the first domain 12*a* is located more closely to the toner core 11 than the second domains 12*b*. The first domain 12*a* is each attached to the surface of the toner core 11. Some second domains 12*b* are attached to the surface of the first domain 12*a*. By contrast, some second domains 12*b* may be attached to the surface of the toner core 11 in a region of a surface region of the toner core 11 where no first domain 12*a* is present.

The surface of the toner core 11 is partly covered with the shell layer 12. A region of the surface region of the toner core 11 covered with either or both of the first and second domains 12*a* and 12*b* corresponds to covered regions (regions each covered with the shell layer 12). A region of the shell layer 12 (specifically, a region in a direction perpendicular to a thickness direction of the shell layer 12) can be divided into the following three regions (first to third regions).

The first region is a region of the shell layer 12 that is constituted only by the first domain 12*a* directly covering the surface of the toner core 11 (region in which no second domain 12*b* is present on the first domain 12*a*).

There are regions in which the second domains 12*b* are present and regions in which no second domain 12*b* is present among regions of the surface of the toner core 1 that are exposed from the first domain 12*a*. The second region is a region of the shell layer 12 that is constituted only by second domains 12*b* directly covering the surface of the toner core 11.

In a surface region of each first domain 12*a*, there are a region in which a second domain 12*b* is present and a region in which no second domain 12*b* is present. The presence of a second domain 12*b* on a first domain 12*a* covering the surface of the toner core 11 means that the surface of the toner core 11 is covered with both the first and second domains 12*a* and 12*b*. The first domain 12*a* located below the second domain 12*b* (on the side close to the toner core 11) directly covers the surface of the toner core 11, while the second domain 12*b* located on the first domain 12*a* (on a side away from the toner core 11) indirectly covers the surface of the toner core 11. The third region is a region of the shell layer 12 in which the first domain 12*a* and second domains 12*b* that cover the surface of the toner core 11 are superposed on one on the other.

The shell layer 12 has regions (first regions) each constituted only by a first domain 12*a*, a region (second region) constituted only by second domains 12*b*, and a region (third region) in which the first domain 12*a* and second domains 12*b* are superposed on one another. The area of the second region is preferably larger than the area of the third region in order to improve both high-temperature preservability and low-temperature fixability of the toner. In a configuration in which the area of the third region is too large, it is expected to be difficult to fix toner at low temperature. In a configuration in which the area of the second region is too small, the second domains 12*b* are expected to insufficiently exhibit a role for improving high-temperature preservability of the toner.

Referring to FIG. 2, a first height D1 indicates a height of a first domain 12*a* from the surface of the toner core 11. A second height D2 indicates a height of a second domain 12*b* from the surface of the toner core 11. The first height D1 is a height of a first domain 12*a* measured in a first region of the shell layer 12. The second height D2 is a height of a second domain 12*b* measured in a second region of the shell layer 12. The first and second heights D1 and D2 each correspond to a thickness of the shell layer 12. The first shell thickness in the above basic structure corresponds to an arithmetic mean value of first heights D1 (for example, an arithmetic mean of ten or more measured values). The second shell thickness in the above basic structure corresponds to an arithmetic mean value of second heights D2 (for example, an arithmetic mean of ten or more measured values).

Figure 3:
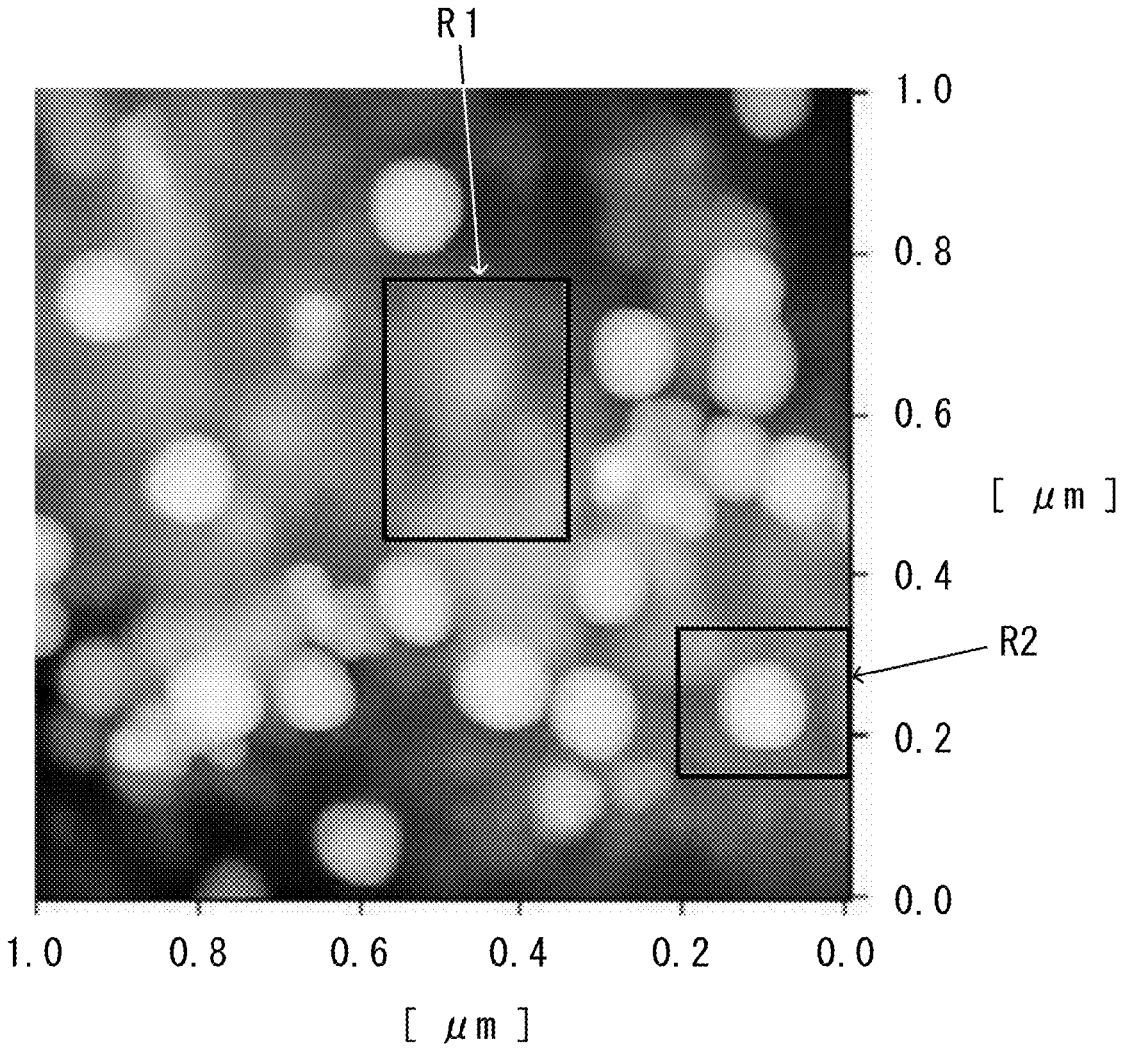
FIG. 3 is a photograph of a surface of a toner mother particle taken for the toner according to the embodiment of the present disclosure using a scanning probe microscope (SPM).

The first and second domains 12*a* and 12*b* can be confirmed by observing the surface of a toner mother particle 10 using a scanning probe microscope (SPM). FIG. 3 is a photograph of the surface of the toner mother particle 10 taken for the toner according to the present embodiment using a SPM. For example, a resin film (a film-shaped first domain 12*a*) can be confirmed in a region R1 in FIG. 3. Also, a resin particle (a particle-shaped second domain 12*b*) can be confirmed in a region R2 in FIG. 3.

Figure 4:
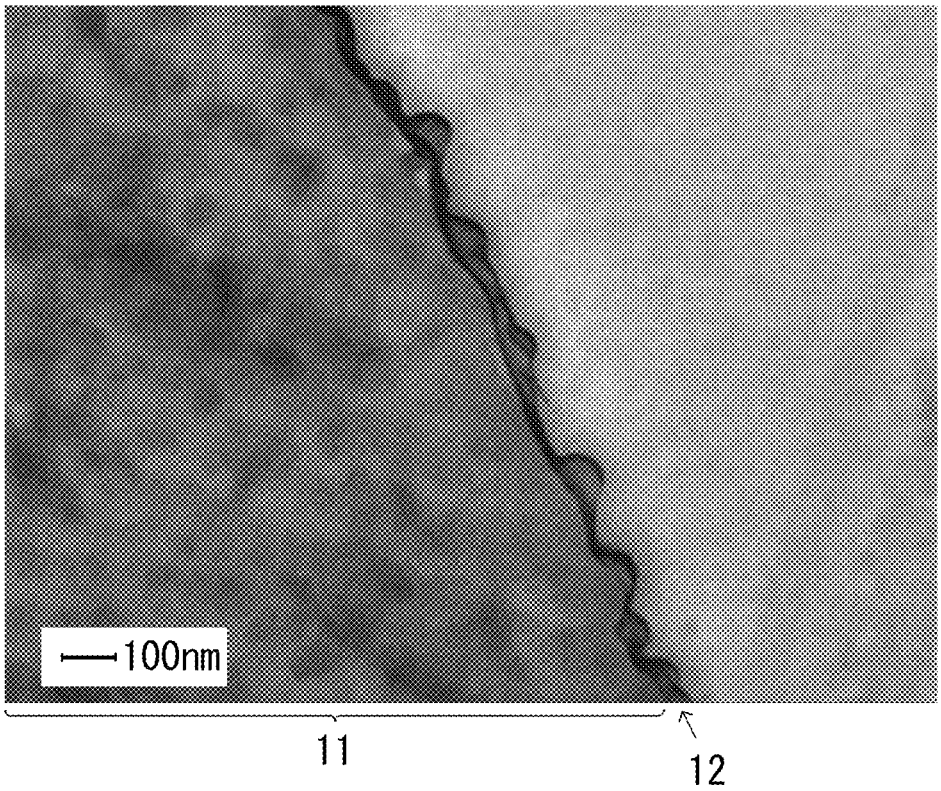
FIG. 4 is a photograph of a section of a toner mother particle (specifically, a section of a shell layer) taken for the toner according to the embodiment of the present disclosure using a transmission electron microscope (TEM).

The first and second shell thicknesses each can be confirmed by observing a cross section of the toner mother particle 10 using a transmission electron microscope (TEM). FIG. 4 is a photograph of a section of the toner mother particle 10 (specifically, section of the shell layer 12) taken for the toner according to the present embodiment using a TEM. It can be confirmed from the photograph of FIG. 4 that the shell layer 12 has projections and recesses (specifically, projections and recesses corresponding to first and second domains 12*a* and 12*b*).

A rate (also referred to below as a first coverage) of a surface region of the toner core covered with the first domain (also referred to below as a first covered region) relative to an entire surface region of the toner core is preferably at least 40% and no greater than 80% in order to improve both high-temperature preservability and low-temperature fixability of the toner. The first covered region includes a surface region of the toner core covered with only a first domain and a surface region of the toner core covered with both first and second domains. The first coverage (unit: %) is represented by an equation "first coverage=100×(area of first covered region)/(area of entire surface region of toner core)". In a configuration in which the first domain is too thick, the first coverage is too high. As such, low-temperature fixability of the toner is expected to be impaired. In a configuration in which the first coverage is too low, many second domains are necessary for ensuring high-temperature preservability of the toner. As such, it is expected to be difficult to improve both high-temperature preservability and low-temperature fixability of the toner.

A rate (also referred to below as a second coverage) of a region (also referred to below as a second covered region) of the toner core covered with either or both of the first domain and the second domains relative to the entire surface region of the toner core is preferably at least 70% and no greater than 99% in order to improve both high-temperature preservability and low-temperature fixability of the toner. The second covered region includes a surface region of the toner core covered with only a first domain, a surface region of the toner core covered with only a second domain, and a surface region of the toner core covered with both first and second domains. The second coverage (unit: %) is represented by an equation "second coverage=100×(area of second covered region)/(area of entire surface region of toner core)".

It is particularly preferable in order to improve both high-temperature preservability and low-temperature fixability of the toner that: first and second domains constitute a stacked structure of the shell layer in which the first and second domains are stacked in the order of the first domain and the second domain from the side close to the toner core; the first coverage is at least 40% and no greater than 80%; and the second coverage is at least 70% and no greater than 99%.

The toner preferably has a volume median diameter ($D_{50}$) of at least 1 μm and less than 10 μm in order to improve both high-temperature preservability and low-temperature fixability of the toner.

Hereinafter, the cores (a binder resin and an internal additive), the shell layers, and the external additive will be described in order. Non-essential components (for example, an internal additive or an external additive) may be omitted in accordance with the intended use of the toner.

<Preferable Thermoplastic Resin>

Examples of thermoplastic resins that can be preferably used for forming the toner particles (particularly, the toner cores and the shell layers) include styrene-based resins, acrylic acid-based resins (specific examples include an acrylic acid ester polymer and a methacrylic acid ester polymer), olefin-based resins (specific examples include a polyethylene resin and a polypropylene resin), vinyl chloride resins, polyvinyl alcohol, vinyl ether resins, N-vinyl resins, polyester resins, polyamide resins, and urethane resins. A copolymer of any of the resins listed above, that is, a copolymer of any of the resins listed above into which an optional repeating unit is included (specific examples include a styrene-acrylic acid-based resin and a styrene-butadiene-based resin) is also preferably used as a thermoplastic resin forming the toner particles.

A styrene-acrylic acid-based resin is a copolymer of at least one styrene-based monomer and at least one acrylic acid-based monomer. In a situation in which a styrene-acrylic acid-based resin is synthesized, any of styrene-based monomers and any of acrylic acid-based monomers that are listed below can for example be used favorably. Use of an acrylic acid-based monomer having a carboxyl group can result in inclusion of the carboxyl group into a styrene-acrylic acid-based resin. Use of a monomer having a hydroxyl group (specific examples include p-hydroxystyrene, m-hydroxystyrene, and (meth)acrylic acid hydroxyalkyl ester) can result in inclusion of the hydroxyl group into a styrene-acrylic acid-based resin. The acid value of a resultant styrene-acrylic acid-based resin can be adjusted through appropriate adjustment of the amount of the acrylic acid-based monomer to use. The hydroxyl value of the resultant styrene-acrylic acid-based resin can be adjusted through appropriate adjustment of the amount of the hydroxyl group-containing monomer to use.

Examples of preferable styrene-based monomers include styrene, α-methylstyrene, p-hydroxystyrene, m-hydroxystyrene, vinyltoluene, α-chlorostyrene, o-chlorostyrene, m-chlorostyrene, p-chlorostyrene, and p-ethylstyrene.

Examples of preferable acrylic acid-based monomers include (meth)acrylic acids, (meth)acrylic acid alkyl esters, and (meth)acrylic acid hydroxyalkyl esters. Examples of preferable (meth)acrylic acid alkyl esters include (meth) methyl acrylate, (meth)ethyl acrylate, (meth)n-propyl acrylate, (meth)iso-propyl acrylate, (meth)n-butyl acrylate, (meth)iso-butyl acrylate, and (meth)2-ethylhexyl acrylate. Examples of preferable (meth)acrylic acid hydroxyalkyl esters include (meth)2-hydroxyethyl acrylate, (meth)3-hydroxypropyl acrylate, (meth)2-hydroxypropyl acrylate, and (meth)4-hydroxybutyl acrylate.

A polyester resin can be yielded by condensation polymerization of at least one polyhydric alcohol and at least one polybasic carboxylic acid. Examples of alcohols that can be used for synthesis of a polyester resin include dihydric alcohols (specific examples include diols and bisphenols) and tri- or higher-hydric alcohols listed below. Examples of carboxylic acids that can be preferably used for synthesis of a polyester resin include dibasic carboxylic acids and tri- or higher-basic carboxylic acids listed below. The acid value and the hydroxyl value of a polyester resin can be adjusted through appropriate adjustment of the respective amounts of an alcohol and an carboxylic acid to use during synthesis of the polyester resin. Increasing the molecular weight of a polyester resin tends to decrease the acid value and the hydroxyl value of the polyester resin.

Examples of preferable diols include ethylene glycol, diethylene glycol, triethylene glycol, 1,2-propanediol, 1,3-propanediol, 1,4-butanediol, neopentyl glycol, 2-butene-1, 4-diol, 1,5-pentanediol, 1,6-hexanediol, 1,4-cyclohexanedimethanol, dipropylene glycol, polyethylene glycol, polypropylene glycol, and polytetramethylene glycol.

Examples of preferable bisphenols include bisphenol A, hydrogenated bisphenol A, bisphenol A ethylene oxide adducts, and bisphenol A propylene oxide adducts.

Examples of preferable tri- or higher-hydric alcohols include sorbitol, 1,2,3,6-hexanetetraol, 1,4-sorbitan, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol, trimethylolethane, trimethylolpropane, and 1,3,5-trihydroxymethylbenzene.

Examples of preferable dibasic carboxylic acids include maleic acid, fumaric acid, citraconic acid, itaconic acid, glutaconic acid, phthalic acid, isophthalic acid, terephthalic acid, cyclohexanedicarboxylic acid, adipic acid, sebacic acid, azelaic acid, malonic acid, succinic acid, alkyl succinic acids (specific examples include n-butylsuccinic acid, isobutylsuccinic acid, n-octylsuccinic acid, n-dodecylsuccinic acid, and isododecylsuccinic acid), and alkenylsuccinic acids (specific examples include n-butenylsuccinic acid, isobutenylsuccinic acid, n-octenylsuccinic acid, n-dodecenylsuccinic acid, and isododecenylsuccinic acid).

Examples of preferable tri- or higher-basic carboxylic acids include 1,2,4-benzenetricarboxylic acid (trimellitic acid), 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, and EMPOL trimer acid.

[Toner Core]

(Binder Resin)

The binder resin is typically a main component (for example, at least 85% by mass) of the toner cores. Properties of the binder resin are therefore expected to have great influence on an overall property of the toner cores. The toner cores have a strong tendency to be anionic when the binder resin has a group such as an ester group, a hydroxyl group, an ether group, an acid group, or a methyl group. By contrast, the toner cores have a strong tendency to be cationic when the binder resin has a group such as an amino group or an amide group. In order that the binder resin is strongly anionic, the hydroxyl value and the acid value of the binder resin each are preferably no less than 10 mgKOH/g.

The binder resin preferably has one or more groups selected from the group consisting of an ester group, a hydroxyl group, an ether group, an acid group, and a methyl group with either or both of a hydroxyl group and a carboxyl group being more preferable. The binder resin having such a functional group can readily react with the shell material to form chemical bonds. Such chemical bonding causes strong bonding between the toner cores and the shell layers. Furthermore, the binder resin preferably has an activated hydrogen-containing functional group in molecules thereof.

The toner cores preferably contain a crystalline polyester resin in order to improve fixability of the toner in high speed fixing. The toner cores preferably have a glass transition point (Tg) of at least 20° C. and no greater than 55° C. in order to improve fixability of the toner in high speed fixing. The toner core preferably have a softening point (Tm) of no greater than 100° C. in order to improve fixability of the toner in high speed fixing. Note that a method for measuring Tg and Tm is the same as that described in Examples described later or alternative methods thereof. Changing the species or amount (blend ratio) of the components (monomers) of the resin can result in adjustment of either or both of Tg and Tm of the resin. A combination of plural types of resins can also result in adjustment of either or both of Tg and Tm of the binder resin.

The binder resin of the toner cores is preferably a thermoplastic resin (specific examples include "examples of preferable thermoplastic resins" listed above). A styrene-acrylic acid-based resin or a polyester resin is preferably used as the binder resin in order to improve dispersibility of a colorant in the toner cores, chargeability of the toner, and fixability of the toner to a recording medium.

In a configuration in which a styrene-acrylic acid-based resin is used as the binder resin of the toner cores, the styrene-acrylic acid-based resin preferably has a number average molecular weight (Mn) of at least 2,000 and no greater than 3,000 in order to improve strength of the toner cores and fixability of the toner. The styrene-acrylic acid-based resin preferably has a molecular weight distribution (ratio Mw/Mn of mass average molecular weight (Mw) relative to number average molecular weight (Mn)) of at least 10 and no greater than 20.

In a configuration in which a polyester resin is used as the binder resin of the toner cores, the polyester resin preferably has a number average molecular weight (Mn) of at least 1,000 and no greater than 2,000 in order to improve strength of the toner cores and fixability of the toner. The polyester resin preferably has a molecular weight distribution (ratio Mw/Mn of mass average molecular weight (Mw) relative to number average molecular weight (Mn)) of at least 9 and no greater than 21.

(Colorant)

The toner cores may each contain a colorant. The colorant can be a known pigment or dye that matches the color of the toner. The amount of the colorant is preferably at least 1 part by mass and no greater than 20 parts by mass relative to 100 parts by mass of the binder resin in order to form a high-quality image using the toner.

The toner cores may contain a black colorant. Carbon black can for example be used as a black colorant. Alternatively, a colorant that is adjusted to a black color using a yellow colorant, a magenta colorant, and a cyan colorant can for example be used as a black colorant.

The toner cores may contain a non-black colorant such as a yellow colorant, a magenta colorant, or a cyan colorant.

One or more compounds selected from the group consisting of condensed azo compounds, isoindolinone compounds, anthraquinone compounds, azo metal complexes, methine compounds, and arylamide compounds can be used for example as a yellow colorant. Specific examples of yellow colorants that can be preferably used include C. I. Pigment Yellow (3, 12, 13, 14, 15, 17, 62, 74, 83, 93, 94, 95, 97, 109, 110, 111, 120, 127, 128, 129, 147, 151, 154, 155, 168, 174, 175, 176, 180, 181, 191, and 194), Naphthol Yellow S, Hansa Yellow G, and C. I. Vat Yellow.

One or more compounds selected from the group consisting of condensed azo compounds, diketopyrrolopyrrole compounds, anthraquinone compounds, quinacridone compounds, basic dye lake compounds, naphthol compounds, benzimidazolone compounds, thioindigo compounds, and perylene compounds can be used for example as a magenta colorant. Specific examples of magenta colorants that can be preferably used include C. I. Pigment Red (for example, 2, 3, 5, 6, 7, 19, 23, 48:2, 48:3, 48:4, 57:1, 81:1, 122, 144, 146, 150, 166, 169, 177, 184, 185, 202, 206, 220, 221, and 254).

One or more compounds selected from the group consisting of copper phthalocyanine compounds, anthraquinone compounds, and basic dye lake compounds can be used for example as a cyan colorant. Examples of cyan colorants that can be preferably used include C. I. Pigment Blue (1, 7, 15, 15:1, 15:2, 15:3, 15:4, 60, 62, and 66), Phthalocyanine Blue, C. I. Vat Blue, and C. I. Acid Blue.

(Releasing Agent)

The toner cores may each contain a releasing agent. The releasing agent is for example used in order to improve fixability of the toner or resistance of the toner to being offset. The toner cores are preferably produced using an anionic wax in order to increase anionic strength of the toner cores. The amount of the releasing agent is preferably at least 1 part by mass and no greater than 30 parts by mass relative to 100 parts by mass of the binder resin in order to improve fixability or offset resistance of the toner.

Examples of releasing agents that can be preferably used include: aliphatic hydrocarbon waxes such as low molecular weight polyethylene, low molecular weight polypropylene, polyolefin copolymer, polyolefin wax, microcrystalline wax, paraffin wax, and Fischer-Tropsch wax; oxides of aliphatic hydrocarbon waxes such as polyethylene oxide wax and block copolymer of polyethylene oxide wax; plant waxes such as candelilla wax, carnauba wax, Japan wax, jojoba wax, and rice wax; animal waxes such as beeswax, lanolin, and spermaceti; mineral waxes such as ozokerite, ceresin, and petrolatum; waxes having a fatty acid ester as a main component such as montanic acid ester wax and castor wax; and waxes in which a part or all of a fatty acid ester has been deoxidized such as deoxidized carnauba wax. One of the releasing agents listed above may be used, or a combination of two or more of the releasing agents listed above may be used.

A compatibilizer may be added to the toner cores in order to improve compatibility between the binder resin and the releasing agent.

(Charge Control Agent)

The toner cores may each contain a charge control agent. The charge control agent is for example used in order to improve charge stability or a charge rise characteristic of the toner. The charge rise characteristic of the toner is an indicator as to whether the toner can be charged to a specific charge level in a short period of time.

Containment of a negatively chargeable charge control agent (specific examples include an organic metal complex and a chelate compound) in the toner cores can increase anionic strength of the toner cores. By contrast, containment of a positively chargeable charge control agent (specific examples include pyridine, nigrosine, and quaternary ammonium salt) in the toner cores can increase cationic strength of the toner core. However, the toner cores need not to contain a charge control agent in a configuration in which sufficient chargeability of the toner can be ensured.

(Magnetic Powder)

The toner cores may each contain a magnetic powder. Examples of materials of the magnetic powder that can be preferably used include ferromagnetic metals (specific examples include iron, cobalt, nickel, and an alloy containing one or more of the listed metals), ferromagnetic metal oxides (specific examples include ferrite, magnetite, and chromium dioxide), and materials subjected to ferromagnetization (specific examples include carbon materials to which ferromagnetism is imparted through thermal treatment). One type of the magnetic powders listed above may be used, or a combination of two or more types of the magnetic powders listed above may be used.

The magnetic powder is preferably subjected to surface treatment in order to inhibit elution of metal ions (e.g., iron ions) from the magnetic powder. In a situation in which the shell layers are formed over the surfaces of the toner cores under acidic conditions, elution of metal ions to the surfaces of the toner cores may cause the toner cores to adhere to one another more readily. It is expected that inhibition of elution of metal ions from the magnetic powder can inhibit toner cores from adhering to one another.

[Shell Layer]

The toner according to the present embodiment has the above basic structure. The shell layers each have the first domain having a film-shape and the second domains each having a particle shape. The first domain is formed substantially from the non-crosslinked resin. The second domains are formed substantially from the crosslinked resin.

The first and second domains each are preferably formed substantially from a polymer (resin) of monomers containing at least one vinyl compound. A polymer of monomers containing at least one vinyl compound has a repeating unit derived from the vinyl compound. When domains are formed through polymerization of a vinyl compound having a functional group according to a desired function to be imparted to the toner, the function can be imparted to the domains easily and accurately. Note that the vinyl compound is a compound having a vinyl group ($CH_2{=}CH{-}$) or a group substituted by hydrogen in a vinyl group (specific examples include ethylene, propylene, butadiene, vinyl chloride, acrylic acid, methyl acrylate, methacrylic acid, methyl methacrylate, acrylonitrile, and styrene). The vinyl compound can be a macromolecule (resin) through addition polymerization by carbon double bonding "C=C" included in the vinyl group or the like.

The non-crosslinked resin forming the first domain is preferably a non-crosslinked thermoplastic resin (specific examples include the "preferable thermoplastic resins" listed above) and particularly preferably a non-crosslinked styrene-acrylic acid-based resin in order to improve both high-temperature preservability and low-temperature fixability of the toner.

Examples of non-crosslinked resins that can preferably form the first domain include a polymer (also referred to below as a specific non-crosslinked resin) of at least one styrene-based monomer, at least one (meth)acrylic acid alkyl ester, and at least one (meth)acrylic acid hydroxyalkyl ester. A polymer such as above has at least one repeating unit derived from the styrene-based monomer, at least one repeating unit derived from (meth)acrylic acid alkyl ester, and at least one repeating unit derived from (meth)acrylic acid hydroxyalkyl ester.

Examples of preferable repeating units derived from a styrene-based monomer that the specific non-crosslinked resin forming the first domain has include a repeating unit represented by the following formula (1).

(1)

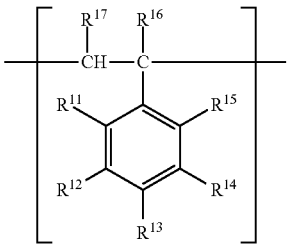

In the formula (1), $R^{11}$ to $R^{15}$ each represent, independently of one another, a hydrogen atom, a halogen atom, a hydroxyl group, an optionally substituted alkyl group, an optionally substituted alkoxy group, or an optionally substituted aryl group. Further, $R^{16}$ and $R^{17}$ each represent, independently of one another, a hydrogen atom, a halogen atom, or an optionally substituted alkyl group. Preferably, $R^{11}$ to $R^{15}$ each represent, independently of one another, a hydrogen atom, a halogen atom, an alkyl group having a carbon number of at least 1 and no greater than 4, an alkoxy group having a carbon number of at least 1 and no greater than 4, or an alkoxyalkyl group having a carbon number (specifically, a total carbon number of alkoxy and alkyl) of at least 2 and no greater than 6. Preferably, $R^{16}$ and $R^{17}$ each represent, independently of one another, a hydrogen atom or a methyl group. A combination of $R^7$ representing a hydrogen atom and $R^{16}$ representing a hydrogen atom or a methyl group is particularly preferable. Note that $R^{11}$ to $R^{17}$ each represent a hydrogen atom in a repeating unit derived from styrene. Further, $R^{13}$ represents a chloro group (Cl—) and $R^{11}$, $R^{12}$, and $R^{14}$ to $R^{17}$ each represent a hydrogen atom in a repeating unit derived from 4-chlorostyrene. In a repeating unit derived from 2-(ethoxymethyl)styrene, $R^{11}$ represents an ethoxymethyl group ($C_2HsOCH_2$—) and $R^{12}$ to $R^{17}$ each represent a hydrogen atom.

A repeating unit having the highest molar ratio among repeating units that the resin forming the first domain has is preferably a repeating unit derived from a styrene-based monomer in order that the shell layers have sufficiently strong hydrophobicity and appropriate strength.

Examples of preferable repeating units derived from (meth)acrylic acid hydroxyalkyl ester that the specific non-crosslinked resin forming the first domain has include a repeating unit represented by the following formula (2).

(2)

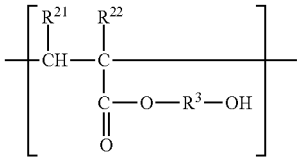

In the formula (2), $R^{21}$ and $R^{22}$ each represent, independently of one another, a hydrogen atom, a halogen atom, or an optionally substituted alkyl group. Further, $R^3$ represents an optionally substituted alkylene group. Preferably, $R^{21}$ and $R^{22}$ each represent, independently of one another, a hydrogen atom or a methyl group. A combination of $R^{21}$ representing a hydrogen atom and $R^{22}$ representing a hydrogen atom or a methyl group is particularly preferable. Preferably, $R^3$ represents an alkylene group having a carbon number of at least 1 and no greater than 6 with an alkylene group having a carbon number of at least 1 and no greater than 4 being more preferable. In a repeating unit derived from 2-hydroxyethyl methacrylate (HEMA): $R^{21}$ represents a hydrogen atom; $R^{22}$ represents a methyl group; and $R^3$ represents an ethylene group (—$(CH_2)_2$—).

Preferably, the specific non-crosslinked resin forming the first domain does not have a repeating unit having at least one of an acid group, a hydroxyl group, and salts thereof except a repeating unit having an alcoholic hydroxyl group in order to inhibit separation of the shell layers and sufficiently inhibit adsorption of moisture in the air to the surfaces of the shell layers.

The crosslinked resin forming the second domains is preferably a thermoplastic resin having cross-linking structure (specific examples include the "preferable thermoplastic resins" listed above) and more preferably a crosslinked acrylic acid-based resin in order to improve both high-temperature preservability and low-temperature fixability of the toner. Di(meth)acrylic acid ester of alkylene glycol (specific examples include ethylene glycol dimethacrylate) is preferable as a cross-linking agent for introducing cross-linking structure to the acrylic acid-based resin.

A crosslinked resin cross-linked with di(meth)acrylic acid ester of alkylene glycol has a repeating unit derived from di(meth)acrylic acid ester of alkylene glycol. Examples of preferable repeating units derived from di(meth)acrylic acid ester of alkylene glycol that the crosslinked resin forming the second domains has include a repeating unit represented by the following formula (3).

(3)

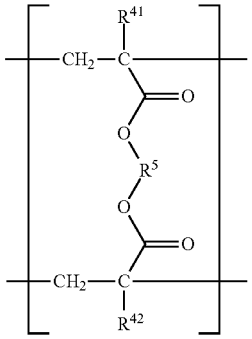

In the formula (3): $R^{41}$ represents a hydrogen atom or a methyl group; $R^{42}$ represents a hydrogen atom or a methyl group; and $R^5$ represents an optionally substituted alkylene group. Preferably, $R^5$ represents an alkylene group having a carbon number of at least 1 and no greater than 8 with an alkylene group having a carbon number of at least 1 and no greater than 4 being more preferable. Note that $R^{41}$ and $R^{42}$ each represent a methyl group and $R^5$ represents an ethylene group (—$(CH_2)_2$—) in a repeating unit derived from ethylene glycol dimethacrylate.

In a preferable example of the toner, the toner cores contain a polyester resin and each have the first domain formed substantially from the non-crosslinked styrene-acrylic acid-based resin and the second domains made substantially of the crosslinked acrylic acid-based resin. A toner such as above tends to be excellent in all of high-temperature preservability, low-temperature fixability, and chargeability. Further, the first and second domains tend to be readily charged positively. As such, electrical repulsion among the first and second domains tends to cause the second domains to be disposed in gaps in the first domain. The toner cores tend to be readily charged negatively. As such, the toner cores tend to bond to the shell layers strongly.

It is preferable that the non-crosslinked styrene-acrylic acid-based resin forming the first domain has one or more repeating units each derived from a styrene-based monomer, one or more repeating units each derived from (meth)acrylic acid alkyl ester, and one or more repeating units each having an alcoholic hydroxyl group and a repeating unit having the highest molar ratio among the repeating units that the resin forming the first domain has is a repeating unit derived from a styrene-based monomer. Examples of preferable styrene-based monomers include styrene, alkyl styrene having an alkyl group having a carbon number of at least 1 and no greater than 4 (specific examples include methylstyrene and butylstyrene), alkoxy styrene having an alkoxy group having a carbon number of at least 1 and no greater than 4 (specific examples include methoxystyrene), alkoxy alkyl styrene having an alkoxy alkyl group having a carbon number (specifically, a total carbon number of alkoxy and alkyl) of at least 2 and no greater than 6 (specific examples include 2-(ethoxymethyl)styrene), bromostyrene, and chlorostyrene. Examples of preferable (meth)acrylic acid alkyl esters include (meth)methyl acrylate, (meth)ethyl acrylate, (meth) n-propyl acrylate, (meth)iso-propyl acrylate, (meth)n-butyl acrylate, and (meth)iso-butyl acrylate. A preferable monomer having an alcoholic hydroxyl group (monomer for including a repeating unit having an alcoholic hydroxyl group into a resin) is 2-hydroxy alkyl ester (meth)acrylate. Examples of preferable 2-hydroxy alkyl ester (meth)acrylates include 2-hydroxyethyl acrylate (HEA), 2-hydroxy propyl acrylate (HPA), 2-hydroxyethyl methacrylate (HEMA), and 2-hydroxy propyl methacrylate.

A particularly preferable crosslinked acrylic acid-based resin forming the second domains is a polymer of (meth) acrylic acid alkyl ester having at an ester portion thereof an alkyl group having a carbon number of at least 1 and no greater than 3 (specific examples include methyl methacrylate) and di(meth)acrylic acid ester of alkylene glycol having an alkylene group having a carbon number of at least 1 and no greater than 4 (specific examples include ethylene glycol dimethacrylate and dimethacrylate butanediol).

The shell layers preferably contain a cationic surfactant in order to increase strength of positive chargeability of the toner. By leaving a cationic surfactant used for forming the shell layers rather than thorough removal thereof, the shell layers can remain containing the cationic surfactant. In a situation for example in which a suspension (shell material) of resin particles is prepared using a cationic surfactant, the cationic surfactant is attached to the surfaces of the resin particles in a suspension when the cationic surfactant is left in the suspension. Formation of shell layers using a suspension as above can result in the shell layers in which the cationic surfactant is attached to the surfaces of either or both of the first and second domains. Examples of cationic surfactants that can be contained in the shell layers include amine salts (specific examples include an acetic acid salt of primary amine) and quaternary ammonium salts (specific examples include an alkyl trimethyl ammonium salt, a dialkyl dimethyl ammonium salt, an alkyl benzyl dimethyl ammonium salt, an acryloyloxyalkyl trimethyl ammonium salt, a methacryloyloxy alkyl trimethyl ammonium salt, and benzethonium chloride).

[External Additive]

An external additive may be attached to the surfaces of the toner mother particles. When the toner mother particles (powder) and the external additive (powder of inorganic particles) are stirred together, parts (bottom parts) of the external additive particles are embedded in surface layer portions of the toner mother particles such that the external additive particles are attached to the surfaces of the toner mother particles by a physical power (physical bond). The external additive is used for example for improving fluidity or handling property of the toner. The amount of the external additive is preferably at least 0.5 parts by mass and no greater than 10 parts by mass relative to 100 parts by mass of the toner mother particles in order to improve fluidity or handling property of the toner. In order to improve fluidity or handling property of the toner, the external additive preferably has a particle diameter of at least 0.01 μm and no greater than 1.0 μm.

Inorganic particles are preferable and silica particles or particles of metal oxides (specific example include alumina, titanium oxide, magnesium oxide, zinc oxide, strontium titanate, and barium titanate) are particularly preferable as the external additive particles. One type of external additive particles may be used, or a combination of two or more types of external additive particles may be used.

[Toner Production Method]

Following describes an example of a method for producing the toner according to the present embodiment that has the above basic structure. First of all, toner cores are prepared. Subsequently, the toner cores and a shell material are added to a liquid. It is preferable to dissolve or disperse the shell material in the liquid by for example stirring the liquid containing the shell material in order to form a uniform shell layer. Subsequently, the shell material and the toner cores are bonded together by for example keeping the liquid at high temperature to form shell layers (hardened resin layers) on the surfaces of the toner cores. In order to inhibit dissolution or elution of toner core components (particularly, a binder resin and a releasing agent) during formation of the shell layers, the formation of the shell layers is preferably carried out in an aqueous medium. The aqueous medium is a medium of which main component is water (specific examples include pure water and a liquid mixture of water and a polar medium). The aqueous medium may function as a solvent. A solute may be dissolved in the aqueous medium. The aqueous medium may function as a dispersion medium. A dispersoid may be dispersed in the aqueous medium. Examples of polar mediums in the aqueous medium that can be used include alcohols (specific examples include methanol and ethanol). The boiling point of the aqueous medium is approximately 100° C.

Following describes a method for producing the toner according to the present embodiment by referring to a more specific example.

(Preparation of Toner Cores)

In order to easily obtain preferable toner cores, the toner cores are preferably produced according to an aggregation method or a pulverization method and more preferably according to the pulverization method.

An example of the pulverization method will be described below. First, a binder resin and an internal additive (for example, at least one of a colorant, a releasing agent, a charge control agent, and a magnetic powder) are mixed together. Subsequently, the resultant mixture is melt-knead. The resultant melt-knead substance is pulverized and classified. Through the above, toner cores having a desired particle diameter can be obtained.

An example of the aggregation method will be described below. First, binder resin particles, releasing agent particles, and colorant particles are aggregated until the particles each have a desired particle diameter in an aqueous medium containing the respective particles. As a result, aggregated particles of the binder resin, the releasing agent, and the colorant are formed. Subsequently, the resultant aggregated particles are heated for coalescence of the components contained in the aggregated particles. As a result, a dispersion of the toner cores is obtained. Thereafter, unnecessary substances (a surfactant and the like) are removed from the dispersion of the toner cores to obtain toner cores.

(Formation of Shell Layer)

An aqueous medium (for example, ion exchanged water) is prepared as the liquid to which the toner cores and the shell material are added. Subsequently, the pH of the aqueous medium is adjusted to a specific pH (for example, at least 3 and no greater than 5) using for example hydrochloric acid. Subsequently, toner cores and a suspension of a non-crosslinked resin (liquid containing non-crosslinked resin particles) are added to the aqueous medium of which pH has been adjusted (for example, acidic aqueous medium).

The toner cores and the shell material may be added to the aqueous medium at room temperature or the aqueous medium of which temperature is adjusted (kept) at a specific temperature. An appropriate amount of the shell material to add can be calculated based on the specific surface area of the toner cores.

The non-crosslinked resin particles are attached to the surfaces of the toner cores in the liquid. Preferably, the toner cores are highly dispersed in the liquid containing the non-crosslinked resin particles in order to uniformly attach the non-crosslinked resin particles to the surfaces of the toner cores. In order to highly disperse the toner cores in the liquid, the liquid may contain a surfactant or be stirred using a high-power stirrer (for example, "Hivis Disper Mix" manufactured by PRIMIX Corporation). Examples of surfactants that can be used include sulfate ester salts, sulfonic acid salts, phosphate ester salts, and soap.

Subsequently, the temperature of the liquid containing the toner cores and the non-crosslinked resin particles is increased to a first retention temperature (preferably, a temperature satisfying "(Tg of non-crosslinked resin)−5° C.≤(first retention temperature)≤(Tg of non-crosslinked resin)+20° C.)" at a specific speed (for example at least 0.1° C./min. and no greater than 3° C./min.) while the liquid is stirred (first temperature increasing treatment). Alternatively, the temperature of the liquid may be kept at the first retention temperature for a specific time period (for example, at least one minute and no greater than 60 minutes) while the liquid is stirred after the first temperature increasing treatment (after the temperature of the liquid reaches the first retention temperature). The non-crosslinked resin particles are expected to be dissolved during the first temperature increasing treatment (during the time when the temperature of the liquid is increased to the first retention temperature) or after the first temperature increasing treatment (during the time when the temperature of the liquid is kept at the first retention temperature). Adjustment of the first retention temperature and Tg of the non-crosslinked resin can result in adjustment of a dissolved state of the non-crosslinked resin particles. For example, once the resin particles are completely dissolved, a film having no granular appearance can be formed.

Subsequently, a suspension of a crosslinked resin (liquid containing crosslinked resin particles) is added to the liquid. The temperature of the liquid is increased to a second retention temperature (preferably, a temperature satisfying "(Tg of non-crosslinked resin)−5° C.≤(second retention temperature)≤(Tg of crosslinked resin)−20° C.)" at a specific speed (for example, at least 0.1° C./min. and no greater than 3° C./min.) while the liquid is stirred (second temperature increasing treatment). Note that the second retention temperature may be equal to the first retention temperature. In a method in which the second retention temperature is equal to the first retention temperature, the second temperature increasing treatment may be omitted.

Subsequently, the temperature of the liquid containing the crosslinked resin particles is kept at the second retention temperature for a specific time period (for example, at least 30 minute and no greater than four hours) while the liquid is stirred. The shell layers are formed on the surfaces of the toner cores during the temperature increasing treatment (first or second temperature increasing treatment) or during the time when the temperature of the liquid is kept at high temperature (the first or second retention temperature). Specifically, it is expected that a non-crosslinked resin film (first domain) is formed on the surfaces of the toner cores and crosslinked resin particles (second domains) are attached to gaps among the non-crosslinked resin films.

After the shell layers are formed as above, a dispersion of toner mother particles is cooled to for example normal temperature (approximately 25° C.). The dispersion of the toner mother particles is then filtered using for example a Buchner funnel. Filtration of the dispersion of the toner mother particles separates the toner mother particles from the liquid (solid-liquid separation), thereby collecting a wet cake of the toner mother particles. Next, the resultant wet cake of the toner mother particles is washed. The toner mother particles that have been washed are then dried. Thereafter, as necessary, the toner mother particles may be mixed with an external additive using a mixer (for example, an FM mixer manufactured by Nippon Coke & Engineering Co., Ltd.) to attach the external additive to the surfaces of the toner mother particles. In a situation in which a spray dryer is used in the drying process, the drying process and the external additive process can be carried out at the same time by spraying a dispersion of an external additive (for example, silica particles) to the toner mother particles. Through the above, a toner containing multiple toner particles is produced.

Note that processes and order of the method for producing the toner described above may be changed freely in accordance with desired structure, characteristics, and the like of the toner. The toner may be sifted after external addition. Also, non-essential processes may alternatively be omitted. For example, in a method in which a commercially available product can be used directly as a material, use of the commercially available product can omit the process of preparing the material. In a method in which reaction for forming the shell layers progresses favorably even without pH adjustment of the liquid, the process of pH adjustment may be omitted. In a method in which no external additive is necessary, the external addition process may be omitted. In a method in which an external additive is not attached to the surfaces of the toner mother particles (i.e., a method in which the external addition process is omitted), the toner mother particles are equivalent to the toner particles. A prepolymer may be used instead of the monomer as a material for resin synthesis (for example, a toner core material or a shell material), depending on necessity. In order to yield a specific compound, a salt, ester, hydrate, or anhydride of the compound may be used as a raw material. Preferably, a large number of the toner particles are formed at the same time in order to produce the toner efficiently. The toner particles produced at the same time are thought to have substantially the same configuration.

EXAMPLES

Following describes examples of the present disclosure. Table 1 indicates toners T-1 to T-15 according to examples and comparative examples (each are an electrostatic latent image developing toner). Table 2 indicates suspensions A-1 to A-5 and B-1 to B-6 used for manufacturing any of the toners T-1 to T-15. The terms "1st" and "2nd" in the item of "height (unit: nm)" in Table 1 mean the first and second shell thicknesses, respectively. The term "particle diameter" in Table 2 means a number average value of equivalent circular diameters of primary particles measured using a scanning electron microscope (SEM).

TABLE 1

| Toner | First shell material Type | First shell material Amount [mL] | Second shell material Type | Second shell material Amount [mL] | Tg difference between shell materials (2nd − 1st) [° C.] | Height [nm] 1st | Height [nm] 2nd | First coverage [%] |
|---|---|---|---|---|---|---|---|---|
| T-1 | A-1 | 15 | B-3 | 20 | 62 (=130 − 68) | 16 | 79 | 69 |
| T-2 | A-2 | | B-3 | | 57 (=130 − 73) | 20 | 83 | 58 |
| T-3 | A-3 | | B-3 | | 48 (=130 − 82) | 44 | 83 | 43 |
| T-4 | A-2 | | B-2 | | 49 (=122 − 73) | 22 | 68 | 71 |
| T-5 | A-1 | | B-1 | | 46 (=114 − 68) | 13 | 56 | 77 |
| T-6 | A-2 | | B-4 | | 52 (=125 − 73) | 20 | 95 | 65 |
| T-7 | A-2 | 10 | B-5 | | 61 (=134 − 73) | 20 | 97 | 38 |
| T-8 | A-4 | 15 | B-2 | | 57 (=122 − 65) | 12 | 76 | 82 |
| T-9 | A-1 | 15 | A-3 | 15 | 14 (=82 − 68) | — | — | 84 |
| T-10 | A-3 | 15 | B-2 | 20 | 40 (=122 − 82) | 41 | 69 | 60 |
| T-11 | A-2 | | B-1 | | 41 (=114 − 73) | 23 | 56 | 63 |
| T-12 | A-4 | 15 | B-1 | 20 | 49 (=114 − 65) | 9 | 56 | 88 |
| T-13 | A-5 | | B-3 | | 46 (=130 − 84) | 51 | 85 | 51 |
| T-14 | A-2 | | B-5 | | 61 (=134 − 73) | 20 | 101 | 65 |
| T-15 | A-1 | | B-6 | | 37 (=105 − 68) | 15 | 48 | 78 |

TABLE 2

| Dispersion | Cross-linking | Tg [° C.] | Particle diameter [nm] |
|---|---|---|---|
| A-1 | Absent | 68 | 53 |
| A-2 | | 73 | 55 |
| A-3 | | 82 | 52 |
| A-4 | | 65 | 53 |
| A-5 | | 84 | 56 |
| B-1 | Present | 114 | 84 |
| B-2 | | 122 | 84 |
| B-3 | | 130 | 90 |
| B-4 | | 125 | 114 |
| B-5 | | 134 | 109 |
| B-6 | | 105 | 77 |

Following describes methods for producing the respective toners T-1 to T-15, evaluation methods, and evaluation results in order. In evaluations in which errors may occur, an evaluation value was calculated by calculating the arithmetic mean of an appropriate number of measured values in order to ensure that any errors were sufficiently small. Respective methods for measuring Tg (glass transition point), Mp (melting point), and Tm (softening point) are those described below unless otherwise stated.

<Methods for Measuring Tg and Mp>

A differential scanning calorimeter ("DSC-6220" manufactured by Seiko Instruments Inc.) was used as a measuring device. Tg and Mp of a sample (for example, a resin) was obtained through measurement of a heat absorption curve of the sample using the measuring device. Specifically, 15 mg of a sample (for example, a resin) was put on an aluminum pan (aluminum container) and the aluminum pan was set on a measurement section of the measuring device. An empty aluminum pan was additionally used as a reference. In measurement of the heat absorption curve, the temperature of the measurement section was increased from a measurement starting temperature of 10° C. to 150° C. at a rate of 10° C./min. (RUN1). Thereafter, the temperature of the measurement section was dropped from 150° C. to 10° C. at a rate of 10° C./min. Subsequently, the temperature of the measurement section was re-increased from 10° C. to 150° C. at a rate of 10° C./min. (RUN2). Performance of RUN2 resulted in plot of a heat absorption curve (vertical axis: heat flow (DSC signals), horizontal axis: temperature) of the sample. Mp and Tg of the sample were read from the heat absorption curve that was plotted. The temperature of a maximum peak derived from heat of fusion on the heat absorption curve corresponds to Mp (melting point) of the sample. Further, a temperature at a point of change (intersection between an extrapolation line of a base line and an extrapolation line of a fall line) in the specific heat on the heat absorption curve corresponds to Tg (glass transition point) of the sample.

<Tm Measuring Method>

A sample (for example, a resin) was placed in a capillary rheometer ("CFT-500D" manufactured by Shimadzu Corporation), and melt-flow of 1 $cm^3$ of the sample was caused using a die diameter of 1 mm, a plunger load of 20 $kg/cm^2$, and a heating rate of 6° C./min. in order to plot an S-shaped curve (horizontal axis: temperature, vertical axis: stroke) of the sample. Then, Tm of the sample was read from the S-shaped curve that was plotted. Tm (softening point) of the sample is a temperature on the S-shaped curve corresponding to a stroke value of $(S_1+S_2)/2$ where $S_1$ represents a maximum value of the stroke and $S_2$ represents a base-line stroke value at low-temperature.

For each of samples (toners T-1 to T-15), the first and second shell thicknesses were measured using a scanning probe microscope (SPM) by the following method and the first coverage of the toner cores was measured using a transmission electron microscope (TEM).

<Method for Measuring First and Second Shell Thicknesses>

A scanning probe station ("NanoNaviReal" manufactured by Hitachi High-Tech Science Corporation) equipped with a scanning probe microscope (SPM) ("multifunctional unit AFM5200S" manufactured by Hitachi High-Tech Science Corporation) was used as a measuring device. Prior to measurement, average toner particles were selected as a measurement target from among toner particles included in a sample (toner) using a scanning electron microscope (SEM) ("JSM-6700F" manufactured by JEOL Ltd.). The toner particles were each directly set on the measurement table without being cut, and a contour image of the toner particle was taken under the following measurement conditions. A field of view of the measuring device was set so that a first region (region constituted only by a film-shape domain) and a second region (region constituted only by a particle-shaped domain) of a shell layer were included in a measurement range.

(SPM Measurement Conditions)

Measurement prove: low-spring constant silicon cantilever ("OMCL-AC240TS-C3" manufactured by Olympus Corporation), spring constant: 2 N/m, resonance frequency: 70 kHz, coating material for back reflection: aluminum).

Measurement mode: sampling intelligent scan-dynamic force mode (SIS-DFM).

Measurement range (per one field of view): 1 μm×1 μm.

Resolution (X data/Y data): 256/256.

A contour image (image showing a surface contour) of the toner particle was taken while a distance between the prove and the toner particle was controlled so that the amplitude of the vibrating cantilever (tip end: prove) was constant in a state in which the cantilever is caused to resonate in the measurement mode (SIS-DFM). The taken contour image was subjected to primary inclination correction, and the respective heights of two types of domains (films-shaped domains and particle-shaped domains) included in the shell layer from the surface of the toner core were measured. Five film-shaped domains were arbitrarily selected in the first regions in the toner particle while the field of view was changed, and the respective heights (first height D1 illustrated in FIG. 2) of the selected five film-shaped domains were measured. Furthermore, five particle-shaped domains were arbitrarily selected in the second region while the field of view was changed and the respective heights (second height D2 illustrated in FIG. 2) of the selected five particle-shaped domains were measured. Five first heights D1 and five second heights D2 were measured for each of ten toner particles contained in the sample (toner). An arithmetic mean of the measured values of the measured 50 first heights D1 and an arithmetic mean of the measured values of the measured 50 second heights D2 were defined as evaluation values (first and second shell thicknesses) of the sample (toner).

<Method for Measuring First Coverage>

A sample (toner) was embedded in a visible photocurable resin ("ARONIX (registered Japanese trademark) D-800" manufactured by Toagosei Co., Ltd.) to yield a hardened material. Thereafter, the yielded hardened material was cut at a cutting rate of 0.3 mm/sec. using a ultrathin piece forming knife ("Sumi Knife (registered Japanese trademark)" manufactured by Sumitomo Electric Industries, Ltd., a diamond knife having a blade width of 2 mm and a blade tip angle of 45°) and a ultramicrotome ("EM UC6" manufactured by Leica Microsystems) to form a thin piece having a thickness of 150 nm. The resultant thin piece was set on a copper mesh and exposed to vapor of an aqueous solution of ruthenium tetroxide for ten minutes for ruthenium dyeing. Subsequently, a section of the dyed sample piece was taken using a transmission electron microscope (TEM) ("JSM-6700F" manufactured by JEOL Ltd.). The taken TEM image was analyzed using image analysis software ("WinROOF" manufactured by Mitani Corporation). A ratio of the total length of regions covered with film-shaped domains relative to the surface region (a contour line indicating an outer circumference) of the toner core was measured in the taken TEM image (sectional image of the toner particle). Specifically, the first coverage was calculated based on an equation "first coverage=100×(total length of regions covered with film-shaped domains)/(circumferential length of toner core)". The first coverage of the toner core was measured for each of ten toner particles contained in the sample (toner). An arithmetic mean of the calculated ten measured values was used as an evaluation value (first coverage) of the sample (toner).

[Methods for Producing Toners T-1 to T-15]

(Synthesis of Crystalline Polyester Resin)

A 10-L four-necked flask equipped with a thermometer (thermocouple), a dewatering conduit, a nitrogen inlet tube, and a stirrer was charged with 2,643 g of 1,6-hexanediol, 864 g of 1,4-butanediol, and 2,945 g of succinic acid. Subsequently, the flask contents were heated to 160° C. to dissolve the charged materials. Then, a liquid mixture of styrene and the like (liquid mixture of 1,831 g of styrene, 161 g of acrylic acid, and 110 g of dicumyl peroxide) was dripped into the flask over one hour using a dripping funnel. The flask contents were stirred at a temperature of 170° C. for one hour for reaction to polymerize styrene and acrylic acid in the flask. Thereafter, unreacted styrene and unreacted acrylic acid in the flask were removed by keeping the flask contents in a reduced-pressure atmosphere (pressure: 8.3 kPa) for one hour. Subsequently, 40 g of tin(II) 2-ethylhexanoate and 3 g of gallic acid were added to the flask. The flask contents were increased in temperature for reaction at a temperature of 210° C. for eight hours. Subsequently, the flask contents were caused to react for one hour in a reduced-pressure atmosphere (pressure: 8.3 kPa) at a temperature of 210° C. As a result, a crystalline polyester resin having Tm of 92° C., Mp of 96° C., and a crystallinity index of 0.95 was yielded. Note that the crystallinity index of a resin corresponds to a rate (=Tm/Mp) of the softening point (Tm) of the resin relative to the melting point (Mp) of the resin.

(Synthesis of Non-Crystalline Polyester Resin A)

A 10-L four-necked flask equipped with a thermometer (thermocouple), a dewatering conduit, a nitrogen inlet tube, and a stirrer was charged with 370 g of a bisphenol A propylene oxide adduct, 3,059 g of a bisphenol A ethylene oxide adduct, 1,194 g of terephthalic acid, 286 g of fumaric acid, 10 g of tin(II) 2-ethylhexanoate, and 2 g of gallic acid. Subsequently, the flask contents were caused to react in a nitrogen atmosphere at a temperature of 230° C. until the reaction rate became at least 90% by mass. The reaction rate was calculated based on an equation "reaction rate=100×(actual amount of reaction product water)/(theoretical amount of reaction product water)". The flask contents were then caused to react in a reduced-pressure atmosphere (pressure: 8.3 kPa) until Tm of a reaction product (resin) became a specific temperature (89° C.). As a result, a non-crystalline polyester resin A was yielded that had a Tm of 89° C. and a Tg of 50° C.

(Synthesis of Non-Crystalline Polyester Resin B)

A non-crystalline polyester resin B was synthesized according to the same method as for the non-crystalline polyester resin A in all aspects other than that 1,286 g of the bisphenol A propylene oxide adduct, 2,218 g of the bisphenol A ethylene oxide adduct, and 1,603 g of terephthalic acid were used instead of 370 g of the bisphenol A propylene oxide adduct, 3,059 g of the bisphenol A ethylene oxide adduct, 1,194 g of terephthalic acid, and 286 g of fumaric acid. The non-crystalline polyester resin B had a Tm of 111° C. and a Tg of 69° C.

(Synthesis of Non-Crystalline Polyester Resin C)

A 10-L four-necked flask equipped with a thermometer (thermocouple), a dewatering conduit, a nitrogen inlet tube, and a stirrer was charged with 4,907 g of a bisphenol A propylene oxide adduct, 1,942 g of a bisphenol A ethylene oxide adduct, 757 g of fumaric acid, 2,078 g of dodecylsuccinic acid anhydride, 30 g of tin(II) 2-ethylhexanoate, and 2 g of gallic acid. Subsequently, the flask contents were caused to react in a nitrogen atmosphere at a temperature of 230° C. until the reaction rate represented by the above equation became at least 90% by mass. The flask contents were then caused to react for one hour in a reduced-pressure atmosphere (pressure: 8.3 kPa). Subsequently, 548 g of trimellitic anhydride was added to the flask and the flask contents were caused to react in a reduced-pressure atmosphere (pressure: 8.3 kPa) at a temperature of 220° C. until the Tm of a reaction product (resin) became a specific temperature (127° C.). As a result, a non-crystalline polyester resin C was yielded that had a Tm of 127° C. and a Tg of 51° C.

(Preparation of Suspension A-1)

A 1-L three-necked flask equipped with a thermometer and a stirring impeller was set in a water bath. The flask was charged with 875 mL of ion exchanged water at a temperature of approximately 30° C. and 75 mL of a cationic surfactant ("Texnol (registered Japanese trademark) R5" manufactured by NIPPON NYUKAZAI CO., LTD., component: alkyl benzyl dimethyl ammonium salt). Next, the internal temperature of the flask was increased to 80° C. using the water bath. Subsequently, two liquids (a first liquid and a second liquid) were each dripped into the flask contents at a temperature of 80° C. over five hours. The first liquid was a liquid mixture of 12 mL of styrene, 4 mL of 2-hydroxybutyl methacrylate, and 4 mL of ethyl acrylate. The second liquid was a solution of 30 mL of ion exchanged water in which 0.5 g of potassium peroxodisulfate was dissolved. Then, the flask contents were polymerized in a state in which the internal temperature of the flask was kept at 80° C. for two hours. As a result, a suspension A-1 of resin particulates was yielded.

(Preparation of Suspension A-2)

A suspension A-2 was prepared according to the same method as for the suspension A-1 in all aspects other than that additive amounts of the materials were changed. Specifically: the additive amount of styrene was changed from 12 mL to 13 mL; the additive amount of 2-hydroxybutyl methacrylate was changed from 4 mL to 5 mL; and the additive amount of ethyl acrylate was changed from 4 mL to 3 mL.

(Preparation of Suspension A-3)

A suspension A-3 was prepared according to the same method as for the suspension A-1 in all aspects other than that the amount of the cationic surfactant ("Texnol (registered Japanese trademark) R5") was changed from 75 mL to 70 mL and the first liquid was changed from the liquid mixture of 12 mL of styrene, 4 mL of 2-hydroxybutyl methacrylate, and 4 mL of ethyl acrylate to a liquid mixture of 13 mL of styrene, 6 mL of 2-hydroxyethyl methacrylate, and 2 mL of methyl acrylate.

(Preparation of Suspension A-4)

A suspension A-4 was prepared according to the same method as for the suspension A-1 in all aspects other than that the amount of the cationic surfactant ("Texnol (registered Japanese trademark) R5") was changed from 75 mL to 70 mL and the first liquid was changed from the liquid mixture of 12 mL of styrene, 4 mL of 2-hydroxybutyl methacrylate, and 4 mL of ethyl acrylate to a liquid mixture of 12 mL of styrene, 2 mL of 2-hydroxybutyl methacrylate, and 4 mL of butyl acrylate.

(Preparation of Suspension A-5)

A suspension A-5 was prepared according to the same method as for the suspension A-1 in all aspects other than the followings. The amount of the cationic surfactant (Texnol (registered Japanese trademark) R5) was changed from 75 mL to 70 mL, and the first liquid was changed from the liquid mixture of 12 mL of styrene, 4 mL of 2-hydroxybutyl methacrylate, and 4 mL of ethyl acrylate to a liquid mixture of 12 mL of styrene, 7 mL of 2-hydroxyethyl methacrylate, and 2 mL of methyl acrylate.

(Preparation of Suspension B-1)

A 3-L flask equipped with a thermometer (thermocouple), a nitrogen inlet tube, a stirrer, and a heat exchanger (condenser) was charged with 1,000 g of ion exchanged water at a temperature of approximately 30° C. and 4 g of a cationic surfactant ("Texnol (registered Japanese trademark) R5" manufactured by NIPPON NYUKAZAI CO., LTD., component: alkyl benzyl dimethyl ammonium salt). Subsequently, nitrogen was introduced into the flask contents for nitrogen substitution for 30 minutes while the flask contents were stirred. Then, 2 g of potassium peroxodisulfate was added to the flask. The flask contents were then stirred for dissolving the potassium peroxodisulfate. While nitrogen was introduced into the flask, the internal temperature of the flask was increased to 80° C. A liquid mixture of 250 g of methyl methacrylate and 4 g of 1,4-butanediol dimethacrylate was dripped into the flask over two hours starting from the time when the internal temperature of the flask reached 80° C. During the dripping of the liquid mixture, the flask contents were kept stirred under conditions of a temperature of 80° C. and a rotational speed of 300 rpm. After the dripping, the flask contents were polymerized in a state in which the internal temperature of the flask was kept at 80° C. for eight hours. As a result, a suspension B-1 of resin particulates (specifically, particles of an acrylic acid-based resin crosslinked by 1,4-butanediol dimethacrylate) was yielded.

(Preparation of Suspension B-2).

A suspension B-2 was prepared according to the same method as for the suspension B-1 in all aspects other than that a liquid mixture of 250 g of methyl methacrylate and 4 g of ethylene glycol dimethacrylate was used instead of the liquid mixture of 250 g of methyl methacrylate and 4 g of 1,4-butanediol dimethacrylic acid.

(Preparation of Suspension B-3)

A suspension B-3 was prepared according to the same method as for the suspension B-2 in all aspects other than that the amount of ethylene glycol dimethacrylate was changed from 4 g to 5 g.

(Preparation of Suspension B-4)

A suspension B-4 was prepared according to the same method as for the suspension B-2 in all aspects other than that the amount of potassium peroxodisulfate was changed from 2 g to 1 g and the amount of methyl methacrylate was changed from 250 g to 275 g.

(Preparation of Suspension B-5)

A suspension B-5 was prepared according to the same method as for the suspension B-2 in all aspects other than that the amount of methyl methacrylate was changed from 250 g to 295 g and the amount of ethylene glycol dimethacrylate was changed from 4 g to 5 g.

(Preparation of Suspension B-6)

A suspension B-6 was prepared according to the same method as for the suspension B-1 in all aspects other than that the amount of 1,4-butanediol dimethacrylic acid was changed from 4 g to 3 g.

The resin particulates contained in the respective suspensions A-1 to A-5 and B-1 to B-6 had number average particle diameters and glass transition points (Tg) indicated in Table 2. For example, the resin particulates contained in the suspension A-1 had a number average particle diameter of 53 nm and a glass transition point (Tg) of 68° C. The suspensions A-1 to A-5 each were a dispersion of a non-crosslinked resin. The suspensions B-1 to B-6 each were a dispersion of a crosslinked resin.

(Preparation of Toner Cores)

An FM mixer ("FM-20B" manufactured by Nippon Coke & Engineering Co., Ltd.) was used to mix 100 g of a first binder resin (crystalline polyester resin synthesized according to the aforementioned process), 300 g of a second binder resin (non-crystalline polyester resin A synthesized according to the aforementioned process), 100 g of a third binder resin (non-crystalline polyester resin B synthesized according to the aforementioned process), 600 g of a fourth binder resin (non-crystalline polyester resin C synthesized according to the aforementioned method), 144 g of a colorant ("Colortex (registered Japanese trademark) Blue B1021" manufactured by SANYO COLOR WORKS, Ltd., component: Phthalocyanine Blue), 12 g of a first releasing agent ("Carnauba wax No. 1" manufactured by S. Kato & Co., component: carnauba wax), and 48 g of a second releasing agent ("NISSAN ELECTROL (registered Japanese trademark) WEP-3" manufactured by NOF Corporation, component: ester wax) at a rotational speed of 2,400 rpm.

The resultant mixture was melt-knead using a twin screw extruder ("PCM-30" manufactured by Ikegai Corp.) under conditions of a material feeding speed of 5 kg/hour, a shaft rotational speed of 160 rpm, and a set temperature (cylinder temperature) of 100° C. The resultant melt-knead product was subsequently cooled. The cooled melt-kneaded product was then coarsely pulverized using a pulverizer ("Rotoplex (registered Japanese trademark)" manufactured by Hosokawa Micron Corporation). Subsequently, the resultant coarsely pulverized product was finely pulverized using a jet mill ("Model-I Super Sonic Jet Mill" manufactured by Nippon Pneumatic Mfg. Co., Ltd.). The resultant finely pulverized product was classified using a classifier ("Elbow Jet EJ-LABO" manufactured by Nittetsu Mining Co., Ltd.). As a result, toner cores were produced that had a Tg of 36° C. and a volume median diameter ($D_{50}$) of 6 μm.

(Formation of Shell Layer)

A 1-L three-necked flask equipped with a thermometer and a stirring impeller was set in a water bath and charged with 300 mL of ion exchanged water. Thereafter, the internal temperature of the flask was kept at 30° C. using the water bath. The pH of the flask contents was then adjusted to pH 4 through addition of dilute hydrochloric acid to the flask. A first shell material (each dispersion indicated in Table 1) was then added to the flask. In manufacture of for example the toner T-1, 15 mL of the suspension A-1 was added to the flask as the first shell material. Subsequently, 300 g of the toner cores (toner cores prepared according to the aforementioned process) were added to the flask and the resultant flask contents were stirred for one hour at a rotational speed of 300 rpm. Thereafter, 300 mL of ion exchanged water was added to the flask.

The internal temperature of the flask was increased to 78° C. at a rate of 1° C./min. while the flask contents were stirred at a rotational speed of 100 rpm. A second shell material (each dispersion indicated in Table 1) was added to the flask when the internal temperature of the flask reached 78° C. In manufacture of for example the toner T-1, 20 mL of the suspension B-3 was added to the flask as the second shell material. The flask contents were then stirred for one hour under conditions of a temperature of 78° C. and a rotational speed of 100 rpm.

The pH of the flask contents was then adjusted to pH 7 through addition of sodium hydroxide to the flask. Subsequently, the flask contents were cooled to normal temperature (approximately 25° C.), thereby yielding a toner mother particle-containing dispersion.

(Washing)

Filtration (solid-liquid separation) of the toner mother particle-containing dispersion yielded as above was performed using a Buchner funnel, thereby collecting a wet cake of the toner mother particles. The toner mother particles in the resultant wet cake were re-dispersed in ion exchanged water. Dispersion and filtration were further repeated five times in order to wash the toner mother particles.

(Drying)

Next, the resultant toner mother particles were dispersed in an aqueous ethanol solution having a concentration of 50% by mass. The dispersion of the toner mother particles yielded a slurry of the toner mother particles. Subsequently, the toner mother particles in the slurry were dried using a continuous surface-modifying apparatus ("Coatmizer (registered Japanese trademark)" manufactured by Freund Corporation) under conditions of a hot air temperature of 45° C. and flow rate of 2 $m^3$/min. As a result, a powder of toner mother particles was obtained.

(External Addition)

An FM mixer ("FM-10B" manufactured by Nippon Coke & Engineering Co., Ltd.) was used to mix 100 parts by mass of the toner mother particles, 1 part by mass of dry silica particles ("AEROSIL (registered Japanese trademark) REA90" manufactured by Nippon Aerosil Co., Ltd., content: dry silica particles to which positive chargeability was imparted through surface treatment, number average primary particle diameter: 20 nm), and 0.5 parts by mass of conductive titanium oxide particles ("EC-100" manufactured by Titan Kogyo, Ltd., matrix: $TiO_2$ particles, coat layer: Sb-doped $SnO_2$ film, number average primary particle diameter: about 0.35 μm) for five minutes. Through the above process, an external additive was attached to the surfaces of the toner mother particles. Thereafter, the resultant powder was sifted using a 200 mesh sieve (opening: 75 μm). As a result, a toner (each toner T-1 to T-15 indicated in Table 1) containing multiple toner particles was produced.

[Evaluation Methods]

Each sample (toners T-1 to T-15) was evaluated according to the following evaluation methods.

(Lowest Fixing Temperature)

A ball mill was used to mix 100 parts by mass of a developer carrier (carrier for "TASKalfa5550ci" manufactured by KYOCERA Document Solutions Inc.) and 10 parts by mass of a sample (toner) for 30 minutes, thereby preparing a two-component developer.

The lowest fixing temperature of the toner was evaluated through formation of an image using the two-component developer prepared as above. An evaluation apparatus used was a color printer including a heat and pressure applying fixing device of roller-roller type ("FS-C5250DN" manufactured by KYOCERA Document Solutions Inc. that was modified as an evaluation apparatus so that the fixing temperature was variable). The two-component developer prepared as above was loaded into a developing device of the evaluation apparatus, and the sample (toner for replenishment use) was loaded into a toner container of the evaluation apparatus.

A solid image (specifically, an unfixed toner image) having a size of 25 mm×25 mm was formed on paper of 90 g/$m^2$ (A4-size printing paper) using the above evaluation apparatus in an environment of a temperature of 23° C. and a humidity of 60% RH under conditions of a linear velocity of 200 mm/sec. and a toner carrying amount of 1.0 mg/$cm^2$.

Subsequently, the paper on which the image has been formed was allowed to pass through the fixing device of the evaluation apparatus.

A fixing temperature set in evaluation of the lowest fixing temperature ranged from at least 100° C. to no greater than 200° C. Specifically, a lowest temperature (lowest fixing temperature) at which a solid image (toner image) was fixable was measured while the fixing temperature of the fixing device was increased 5° C. by 5° C. (2° C. by 2° C. around the lowest fixing temperature) gradually starting from 100° C. Whether or not toner fixing was accomplished was checked by a fold-rubbing test as described below. Specifically, the fold-rubbing test was performed by folding the paper in half such that a surface on which the image was formed was folded inwards, and by rubbing a 1-kg weight covered with cloth back and forth on the fold five times. Next, the paper was opened up and a fold portion (i.e., a portion of the paper on which the solid image was fixed) was observed. The length of toner peeling of the fold portion (peeling length) was measured. The lowest temperature among temperatures for which the peeling length was no greater than 1 mm was determined to be a minimum fixing temperature. A toner having a lowest fixing temperature of no greater than 145° C. was evaluated as good. A toner having a lowest fixing temperature of greater than 145° C. was evaluated as poor.

(High-Temperature Preservability)

A 20-mL polyethylene vessel was charged with 2 g of a sample (toner), sealed, and left to stand for three hours in a constant temperature bath set at a temperature of 58° C. The toner taken out from the constant temperature bath was then cooled to room temperature, thereby obtaining an evaluation toner.

The resultant evaluation toner was placed on a 100-mesh sieve (opening: 150 μm) having a known mass. The mass of the toner prior to sifting was then calculated by measuring the total mass of the sieve and the evaluation toner thereon. Next, the sieve was placed in a powder tester (product of Hosokawa Micron Corporation) and the evaluation toner was sifted in accordance with a manual of the powder tester by shaking the sieve for 30 seconds at a rheostat level of 5. The mass of toner remaining on the sieve was calculated by measuring the total mass of the sieve and toner thereon after the sifting. An aggregation rate (unit: % by mass) was calculated from the mass of the toner prior to sifting and the mass of toner after sifting (mass of toner remaining on the sieve after sifting) based on the following equation.

Agglomeration rate=100×(mass of toner after sifting)/(mass of toner before sifting).

The toner having an agglomeration rate of no greater than 50% by mass was evaluated as good. The toner having an agglomeration rate of greater than 50% by mass was evaluated as poor.

[Evaluation Results]

Table 3 indicates results of evaluation of high-temperature preservability (aggregation rate) and low-temperature fixability (lowest fixing temperature) for the samples (toners T-1 to T-15).

TABLE 3

| | Toner | High-temperature preservability [% by mass] | Low-temperature fixability [° C.] |
|---|---|---|---|
| Example 1 | T-1 | 21 | 130 |
| Example 2 | T-2 | 16 | 134 |
| Example 3 | T-3 | 15 | 142 |
| Example 4 | T-4 | 17 | 134 |
| Example 5 | T-5 | 34 | 126 |

TABLE 3-continued

| | Toner | High-temperature preservability [% by mass] | Low-temperature fixability [° C.] |
|---|---|---|---|
| Example 6 | T-6 | 5 | 136 |
| Example 7 | T-7 | 48 | 138 |
| Example 8 | T-8 | 48 | 140 |
| Comparative Example 1 | T-9 | 68 (poor) | 122 |
| Comparative Example 2 | T-10 | 59 (poor) | 136 |
| Comparative Example 3 | T-11 | 62 (poor) | 130 |
| Comparative Example 4 | T-12 | 55 (poor) | 126 |
| Comparative Example 5 | T-13 | 7 | 150 (poor) |
| Comparative Example 6 | T-14 | 8 | 146 (poor) |
| Comparative Example 7 | T-15 | 64 (poor) | 124 |

The toners T-1 to T-8 (toners according to Examples 1-8) each have the above basic structure. Specifically, the shell layers of the respective toners of Examples 1-8 each had a film-shaped first domain and particle-shaped second domains. The first domain was formed substantially from a non-crosslinked resin, while the second domains were formed substantially from a crosslinked resin (see Tables 1 and 2). The crosslinked resin had a glass transition point (Tg) 45° C. or more greater than the non-crosslinked resin. In the toner T-1, for example, the non-crosslinked resin had a Tg of 68° C. (see Table 2) while the crosslinked resin had a Tg of 130° C. (see Table 2). A Tg difference (=(Tg of crosslinked resin)−(Tg of non-crosslinked resin) was 62° C. (see Table 1). Furthermore, the first domain had an average height (first shell thickness) from the surfaces of the toner cores of at least 10 nm and less than 50 nm. Yet, the second domains had an average height (second shell thickness) from the surfaces of the toner cores of at least 50 nm and no greater than 100 nm. For example, the toner T-1 had a first shell thickness of 16 nm (see Table 1) and a second shell thickness of 79 nm (see Table 1). The toners according to Examples 1-8 each were excellent in both high-temperature preservability and low-temperature fixability, as indicated in Table 3. Note that the shell layers in each of the toners T-1 to T-8 (toners according to Examples 1-8) contained the cationic surfactant. Specifically, the cationic surfactant (alkyl benzyl dimethyl ammonium salt) used in preparation of the shell material (suspension) was attached to the respective surfaces of the first and second domains. Furthermore, the area of the second region was larger than that of the third region. The second coverage was at least 70% and no greater than 99%. A ratio (second coverage) of the total length of regions covered with at least one of film-shaped domains and particle-shaped domains relative to the surface region (a contour line indicating an outer circumference) of the toner core was measured on a taken TEM image (a sectional image of the toner particle). Specifically, the second coverage was calculated based on an equation "second coverage=100×(total length of regions covered with at least one of film-shaped domains and particle-shaped domains)/(circumferential length of toner core)".

What is claimed is:

1. An electrostatic latent image developing toner comprising a plurality of toner particles each including a core and a shell layer disposed over a surface of the core, wherein the shell layer has at least one first domain having a film shape and a plurality of second domains each having a particle shape, the first domain is formed substantially from a non-crosslinked resin, the second domains are formed substantially from a crosslinked resin, the crosslinked resin has a glass transition point 45° C. or more greater than the non-crosslinked resin, the first domain has an average height from the surface of the core of at least 10 nm and less than 50 nm, the second domains have an average height from the surface of the core of at least 50 nm and no greater than 100 nm, and a ratio of a region of the core covered with the first domain relative to an entire surface region of the core is at least 40% and no greater than 80%.

2. The electrostatic latent image developing toner according to claim 1, wherein the first domain and the second domains are stacked in order of the first domain and the second domains from a side close to the core, and a ratio of a region of the core covered with either or both of the first domain and the second domains relative to the entire surface region of the core is at least 70% and no greater than 99%.

3. The electrostatic latent image developing toner according to claim 1, wherein the first and second domains have the same polarity.

4. The electrostatic latent image developing toner according to claim 1, wherein the shell layer contains a cationic surfactant.

5. The electrostatic latent image developing toner according to claim 1, wherein the first domain and the second domains are stacked in order of the first domain and the second domains from a side close to the core.

6. The electrostatic latent image developing toner according to claim 5, wherein the shell layer has a first region constituted only by the first domain, a second region constituted only by some of the second domains, and a third region in which the first domain and some of the second domains are superposed on one another, and an area of the second region is larger than that of the third region.

7. The electrostatic latent image developing toner according to claim 1, wherein a difference obtained by subtracting the average height of the first domain from the average height of the second domains is at least 30 nm and no greater than 90 nm.

8. The electrostatic latent image developing toner according to claim 1, wherein the core contains a polyester resin, the crosslinked resin is a crosslinked acrylic acid-based resin, and the non-crosslinked resin is a non-crosslinked styrene-acrylic acid-based resin.

9. The electrostatic latent image developing toner according to claim 8, wherein the crosslinked acrylic acid-based resin is a polymer of (meth)acrylic acid alkyl ester having at an ester portion thereof an alkyl group having a carbon number of at least 1 and no greater than 3 and di(meth)acrylic acid ester of alkylene glycol having an alkylene group having a carbon number of at least 1 and no greater than 4.

10. The electrostatic latent image developing toner according to claim 8, wherein the non-crosslinked styrene-acrylic acid-based resin has one or more repeating units each derived from a styrene-based monomer, one or more repeating units each derived from (meth)acrylic acid alkyl ester, and one or more repeating units each having an alcoholic hydroxyl group, and one of the one or more repeating units each derived from a styrene-based monomer has a highest molar ratio among the repeating units that the non-crosslinked styrene-acrylic acid-based resin has.

11. The electrostatic latent image developing toner according to claim 1, wherein the core has a glass transition point lower than the non-crosslinked resin.

* * * * *